US005277571A

United States Patent [19]

Brining

[11] Patent Number: 5,277,571

[45] Date of Patent: Jan. 11, 1994

[54] APPARATUS FOR PERFORATION OF A SHEET MATERIAL

[75] Inventor: Richard J. Brining, Old Lyme, Conn.

[73] Assignee: George Schmitt & Co., Inc., Branford, Conn.

[21] Appl. No.: 916,213

[22] Filed: Jul. 17, 1992

[51] Int. Cl.[5] ..... B26D 5/20

[52] U.S. Cl. ..... 425/289; 425/290; 264/156; 83/202

[58] Field of Search ..... 264/153, 154, 155, 156, 264/210.1; 425/289, 290, 291, 294; 226/108, 113, 114; 83/235, 202

[56] References Cited

U.S. PATENT DOCUMENTS

| | | | |
|---|---|---|---|
| 439,723 | 11/1890 | Cox | 101/248 |
| 1,905,446 | 4/1933 | Dewey et al. | 83/235 |
| 2,655,212 | 10/1953 | Stewart | 83/235 |
| 2,748,863 | 6/1956 | Benton | 264/154 |
| 3,102,673 | 9/1963 | Aronson et al. | 226/114 |
| 4,165,666 | 8/1979 | Johnson et al. | 226/113 |
| 4,233,017 | 11/1980 | Lucas et al. | 425/290 |

FOREIGN PATENT DOCUMENTS

| | | | |
|---|---|---|---|
| 53-125481 | 11/1978 | Japan | 425/290 |
| 60-224530 | 11/1985 | Japan | 264/154 |

*Primary Examiner*—Jay H. Woo
*Assistant Examiner*—Duane S. Smith
*Attorney, Agent, or Firm*—St. Onge Steward Johnston & Reens

[57] ABSTRACT

An apparatus for perforating a sheet material provides for a perforating die located intermediate two orbital rollers. The two orbital rollers move in orbital paths in the same orbital direction at the same speed and in positions which are 180 degrees apart. Each roller acts as a temporary storage input and output in opposite phase from each other so that incoming sheet material is alternately stored and dispensed as a loop on the orbital roller. Since the rollers are out of phase, this permits a segment of the sheet material to be stopped intermediate the orbital rollers so that the perforating die can act on the stopped segment.

24 Claims, 5 Drawing Sheets

APPARATUS FOR PERFORATION OF A SHEET MATERIAL

FIELD OF THE INVENTION

The present invention relates to the perforation of sheet materials such as stamps to provide perforations permitting the separation of adjacent stamps or the like in a roll or sheet.

BACKGROUND OF THE INVENTION

Perforating equipment for perforating webs of sheet materials such as stamps have typically used a rotary perforating wheel with a plurality of perforating pins to punch perforations in a web material.

Recently, it has been considered desirable to affix individual postage stamps to solicitations and other mass mailings instead of using metered mail or other forms of postage. The reasoning is that the recipient is likely to view a stamped envelope as a more personalized letter. The affixing of the individual stamps to a mass mailing is generally automated. The equipment typically receives a roll of stamps. The stamps are conveyed by a roller having pins that fit into the perforations to engage the stamp roll and convey it in the equipment. The equipment separates each stamp from the adjacent stamp by separating successive stamps from the stamp roll at a perforation line. This roller has been found to be very sensitive to variations in the distance between perforation lines. The equipment input may become fouled when the roller pins do not engage and convey the stamp.

The separation of successive stamps should occur along each perforation line between adjacent stamps. However, since the equipment is designed for and operated on the assumption that the perforation lines are of uniform distance, variations in the distance between perforation lines may cause the cut edges to become out of register with the stamp perforation edges. This can cause additional registration and alignment problems if the equipment is unable to process the misaligned stamps. Potentially, the equipment output may also become fouled. Thus, with variations in the distance in the perforation lines, the entire stamping operation may have to be halted, the stamp coil relocated, and the faulty stamps replaced. This creates considerable expense if large numbers of stamps must be discarded.

It would be desirable to provide an apparatus and method capable of providing consistently precise perforation lines of an exact distance.

SUMMARY OF THE INVENTION

It is an object of the invention to provide an improved apparatus for and method of perforating a continuous roll of a sheet material to provide tear away perforation lines in a sheet material that are a consistent distance apart. It is an object of the invention to provide such an apparatus and method that will provide the perforation lines in register with printed matter such as postage stamps on the sheet material. It is a further object of the invention to provide a perforated sheet material that is usable in automated stamping equipment with a reduced likelihood of fouling.

These objects and others as set forth herein are provided by an apparatus and method for perforating a continuous roll of a sheet material in accordance with the invention generally comprising a feed mechanism for continuously moving the sheet material from an entry of the apparatus to an exit of the apparatus, a die for perforating the sheet material, an intermittent feed apparatus for intermittently feeding a segment of sheet material to a region of the perforating die, and a mechanism for synchronizing activation of the perforation die to stoppage of movement of the segment of the sheet material in the region of the die.

The intermittent feed apparatus preferably comprises two orbital rollers located with the perforating die located between the rollers. The orbital rollers each have adjustable offset mountings at each end so that the rollers can be driven to travel an orbital path about the axis of the mounting. The two orbital rollers are driven in their respective orbital paths in the same orbital direction at the same speed and in positions which are 180 degrees apart. Consequently, when the two orbital rollers are located a maximum distance apart, a segment of the sheet material located between the two orbital rollers is stopped. This is achieved because each roller acts as a temporary storage input and output in opposite phase from the other. More specifically, at the time the first orbital roller receives incoming sheet material and stores it as a loop of the sheet material, the second roller is dispensing a previously stored loop of sheet material. Consequently, despite a continuous input to and output from the apparatus, there is a segment of sheet material between the two rollers which is momentarily stopped. After the first roller has reached the limits of its storing cycle, it begins to dispense the stored loop of sheet material, and the second roller begins to store a loop of sheet material, thereby advancing the segment of sheet material so that another segment can be perforated by the perforating die. This cycle is continuously repeated to intermittently feed the sheet to the region of the die.

The perforating die is located intermediate the two orbital rollers and preferably includes a moving die and a mating bed. The moving die has a plurality of perforating pins which fit into pin receiving apertures in the mating bed. The moving die is movable by reciprocating motion to cause the perforating pins to perforate the sheet material. The moving die is actuated by a cam lifting apparatus which is commonly driven and timed with the orbiting mountings of the two orbital rollers to synchronize the reciprocating motion of the moving die and the stopping of a sheet segment located between the moving die and the mating bed.

Additional conveyor rollers are provided and are commonly driven to rotate with and at the same speed as the rollers of the orbital rollers. Preferably, speed sensing and feedback electronics and speed controlling electronics responsive to the speed sensing and feedback electronics are provided to maintain registration of the perforations.

Other objects, aspects and features of the present invention in addition to those mentioned above will be pointed out in or will be understood from the following detailed description provided in conjunction with the accompanying drawings.

DETAILED DESCRIPTION OF THE PREFERRED EMBODIMENT

Figure 2:
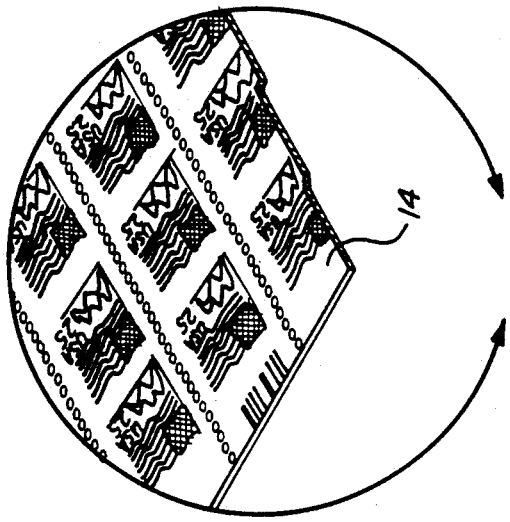
FIG. 2 is a perspective view of a sheet material comprising a sheet of stamps after perforation in the apparatus of FIG. 1.
Figure 1:
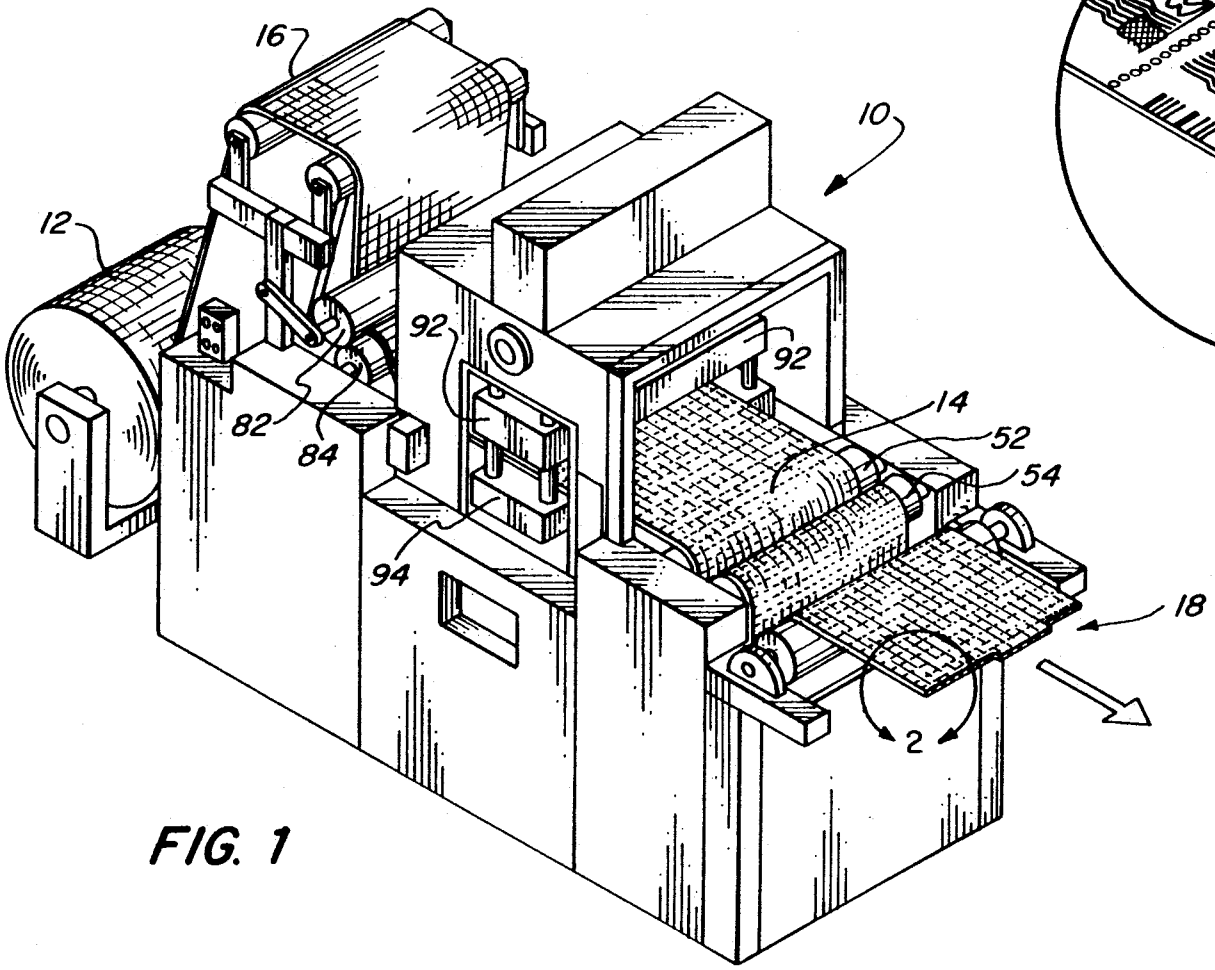
FIG. 1 is a perspective view of an embodiment of an apparatus for perforation of a sheet material in accordance with the invention.

Referring now to FIGS. 1–13, where like elements are identified by like numbers in the drawings, an apparatus is shown generally at 10 which is suited for perforating a continuous roll of a sheet material 12.

Apparatus 10 comprises a feed mechanism 11 for continuously moving the sheet material 12 from an entry 16 of the apparatus 10 to an exit 18 of the apparatus 10. An apparatus for perforating the sheet material 12 is provided as is an intermittent feed apparatus intermediate the entry 16 and the exit 18 for receiving the sheet material 12 and periodically stopping movement of a segment of the sheet material 12. The stopped segment is perforated by the perforating apparatus, creating a perforated sheet material 14.

The intermittent feed apparatus preferably comprises a first orbital roller 20 and a second orbital roller 34. First orbital roller 20 has two ends 22 and 24. Adjustable offset mountings 26 and 28 are located at the ends of the roller 20. The offset mountings 26 and 28 permit the first orbital roller 20 to be movable in an orbital path about the axis of the offset mountings 26 and 28. Second orbital roller 34 similarly has two ends 36 and 38 with offset mountings 40 and 42 located at its ends 36 and 38. Offset mountings 40 and 42 permit the second orbital roller 34 to be movable in an orbital path about the axis of the offset mountings 40 and 42.

As can be seen in FIGS. 4–11, the first orbital roller 20 and the second orbital roller 34 are driven in orbital paths in the same orbital direction at the same speed and in positions which are 180 degrees apart. In other words, the rollers 20 and 34 are moving 180 degrees out of phase. Consequently, when the two orbital rollers 20 and 34 are located a maximum distance apart, a segment 15 of the sheet material 12 located between the two orbital rollers 20 and 34 is stopped. This is achieved because each roller 20 and 34 acts as a temporary storage input and output in opposite phase from each other. More specifically, a first roller 20 receives incoming sheet material 12 and stores it as a loop; in the meantime, second roller 34 is dispensing a previously stored loop of sheet material 15. Consequently, despite a continuous speed input to and output from the apparatus 10, there is a segment 15 of sheet material between the two rollers which is temporarily stopped. After the first roller 20 has reached the limits of its storing cycle, it begins to dispense the stored loop of sheet material, and the second roller begins to store a loop of sheet material, and the segment 15 is advanced from the perforating zone of the moving perforating die 92. This cycle is repeated to periodically stop and start movement of the sheet material between the orbital rollers 20 and 34.

The offset mountings 26 and 28 of the first orbital roller 20 and the offset mountings 40 and 42 of the second orbital roller 34 may in one preferred embodiment be adjustable and may comprise two overlapping metal plates that are slidable relative to each other to adjust a radius R extending from the axes of the offset mountings to the center axes of the orbital rollers 20 and 34. This permits adjustment of the size of the stored loop and therefore the period of time that the segment 15 of the sheet material is stopped. Preferably, the two plates permit a variation in the radius R of up to about one inch.

Figure 13:
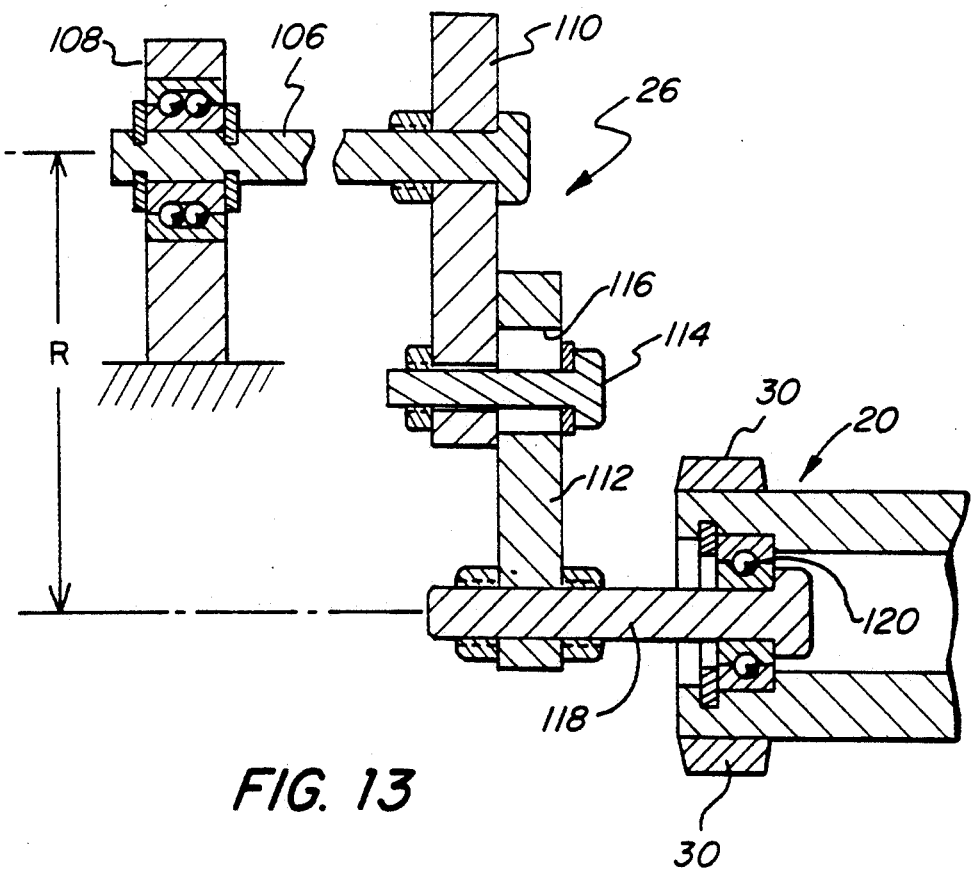
FIG. 13 is a cross-sectional view of an offset mounting of an orbital roller.

The offset mountings 26, 28, 40 and 42 each will preferably be generally constructed as described in reference to offset mounting 26 shown in FIG. 13. A fixed ball bearing mounting 108 is affixed to the framework of apparatus 10 to retain mounting 108 in place. An axle 106 is held by the ball bearing mounting 108. Axle 106 is secured to a square plate 110 by a nut or other fastener. Plate 110 is in turn secured to plate 112 by a fastener 114 which is typically a hex head bolt which mates with a threaded bore and which are provided with a suitable washer. Plate 110 has a hole, and plate 112 has a slot 116, through which fastener 114 secures together plates 110 and 112. The slot 116 permits adjustment of the radius R as desired by sliding the two plates to a greater or lesser degree of overlap. Plate 112 is in turn secured to orbital roller 20 by an axle 118 that extends from the plate 112 to fit into and mate with the ball bearing 120 which is retained in the orbital roller 20.

The apparatus 10 includes a plurality of rollers in addition to the orbital rollers. Referring now to FIGS. 1–11, it can be seen that there are preferably two fixed rollers 48 and 50 flanking the first orbital roller 20, and two fixed rollers 52 and 54 flanking the second orbital roller 34. These fixed rollers 48, 50, 52 and 54 are preferably located in a plane that does not intersect the maximum orbital travel of the orbital rollers 20 and 34. Most preferably, the fixed rollers 48, 50, 52 and 54 are located in a plane above both the plane defined by the central axes of the two pairs of offset mountings and the plane defined by the maximum limit of upward travel of the two orbital rollers 20 and 34. The distance between the fixed rollers 48, 50, 52 and 54 and the orbital rollers 20 and 34 permits the accumulation and storage of loops of sheet material 12 as described herein. In the most preferred embodiment as shown in the drawings, the axes of the two pairs of offset mountings are in one plane, and the four fixed rollers 48, 50, 52 and 54 are in another plane, separated as described. Preferably the distance between the fixed rollers and the orbital rollers will be the same for both the first and second orbital rollers. However, this may be varied as can be determined by a person of ordinary skill in the art, and different distances may be used as needed.

Preferably, fixed rollers 48, 50, 52 and 54 and the orbital rollers 20 and 34 are commonly driven to rotate at the same circumferential feed speed. This is achieved by providing each of the fixed rollers 48, 50, 52 and 54 with a toothed pulley 56 and by providing similarly toothed pulleys 30 and 44 on first and second orbital rollers 20 and 34. The toothed pulleys 56, 30 and 44 are then linked and engaged by a mating endless synchronous belt. Preferably, the linkage is provided by a mating toothed belt 58. The pulleys 30, 44, 56 and 78 preferably are of essentially the same size and belt 58 should have a pitch diameter which is substantially the same as the pitch diameters of the rollers 20, 34, 48, 50, 52 and 54.

In the preferred embodiment, the orbital rollers 20 and 34 travel an orbital path which is counter to the direction of rotation of fixed rollers 48, 50, 52 and 54 which convey the sheet material 12; however, this is not necessary to the effective operation of the invention.

Figure 3:
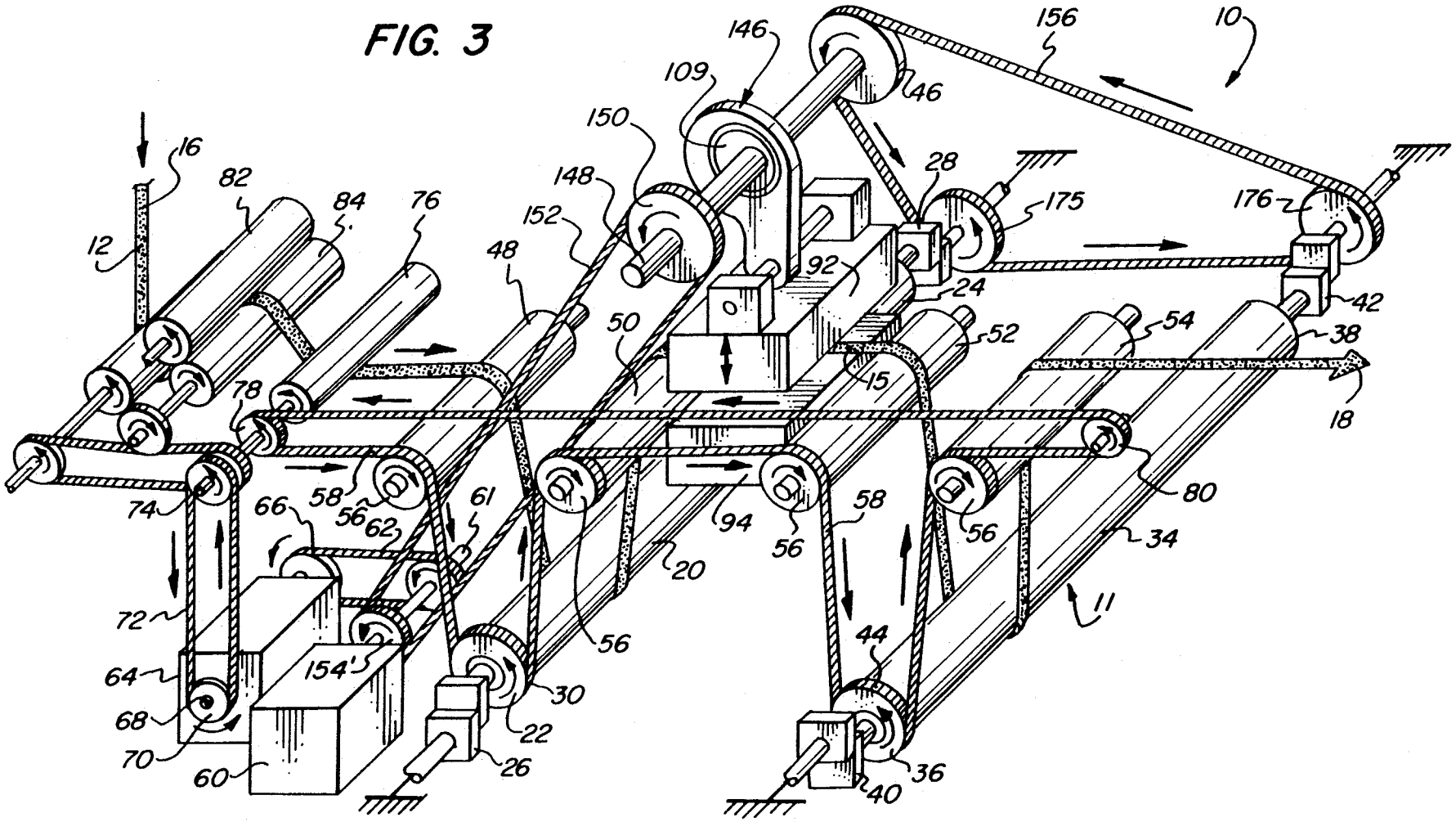
FIG. 3 is a schematic perspective view of the apparatus of FIG. 1 showing the orbital and other rollers and belts for driving same, and a moving die and a mating bed.

Referring now to FIG. 3, belt 58 may be driven either directly or through a series of belt drives linking belt 58 to a primary motor. Preferably, a motor 60 is operated at a fixed rotational speed to operate a drive shaft 61. Drive shaft 61 is connected by a drive belt 62 and toothed pulleys to the input 66 of a transmission 64. The transmission output shaft 68 in turn drives a toothed pulley 70 and drive belt 72. Drive belt 72 drives the shaft 74 of a feed roller 76. Drive shaft 74 is provided with a toothed pulley 78 which engages and drives toothed belt 58 to cause the fixed rollers 48, 50, 52 and 54 and the orbital rollers 20 and 34 to rotate at the same rotational speed.

A belt tightening pulley 80 is preferably provided to permit control of the tautness of the toothed belt 58. Other input rollers are preferably also provided and may include a nip roller 82 and an S roller 84. The nip roller 82 is not powered and merely floats. However, the S roller 84 and others in the apparatus are preferably driven by an appropriate arrangement of linking pulleys and drive belts such that all of the rollers are driven at the same circumferential speed. Consequently, the apparatus 10 conveys sheet material 12 at a substantially constant and equal speed at its entry 16 and its exit 18.

It is to be appreciated that the above described belt drives are not the only possible drive mechanisms, which may properly include chain drives, endless cogged belts and other timed driving mechanisms.

Figure 10:
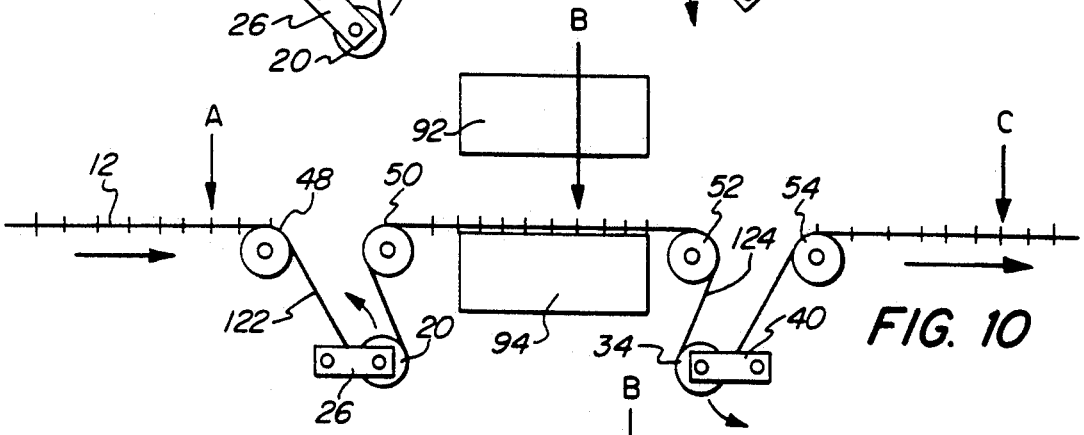
Figure 11:
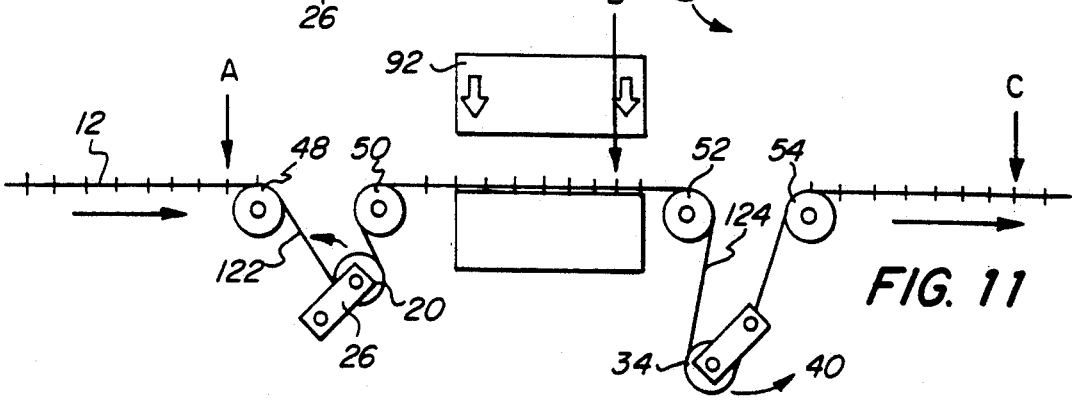
Figure 12:
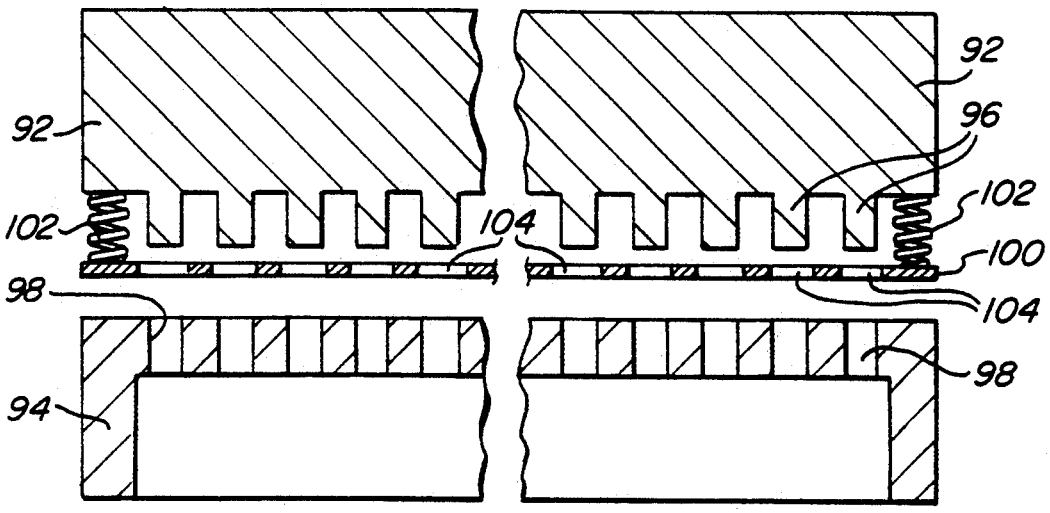
FIG. 12 is a schematic cross-section view of the moving die and mating bed of the apparatus for perforation of a sheet material.

Referring now to FIGS. 1–12, a perforating apparatus is located intermediate the two orbital rollers 20 and 34. In the preferred embodiment, as shown in FIGS. 3 and 12, the perforating apparatus comprises a die having a moving die 92 and a mating bed 94. The moving die 92 has a plurality of perforating pins 96 which fit into pin receiving apertures 98 in the mating bed 94. Preferably, the moving die 92 is provided with a spring loaded apertured plate 100 located between the plurality of pins 96 and the mating bed 94. Plate 100 is mounted by springs 102 to moving die 92. Plate 100 is placeable against the mating bed 94 and upon movement of the moving die 92 towards the mating bed 94 the plurality of pins 96 extend through apertures 104 in the plate 100 and into the mating pin receiving apertures 98 of the mating bed 94. The moving die 92 is movable by reciprocating motion to approach the mating bed 94 to cause the perforating pins 96 to perforate the sheet material 12 and to then retract from the mating bed 94 to cause the perforating pins 96 to be disengaged from the sheet material 12.

The reciprocating moving die 92 is driven by a cam lift apparatus 146 for lifting the moving die 92. Cam lift apparatus 146 has a drive shaft 148. Drive shaft 148 is driven by a toothed pulley 150 which is driven by a drive belt 152 mounted to a pulley 154 on motor 60. Drive shaft 148 has a further toothed pulley 46 that is operably connected by an endless toothed drive belt 156 with pulleys 175 and 176 provided on the offset mountings 28 and 42. This links the orbital rotation of the orbital rollers 20 and 34 with the reciprocating motion of the moving die 92 to synchronize the stopping of the sheet segment 15 between the moving die 92 and the mating bed 94 with the reciprocating motion of the moving die 92.

The cam lift apparatus operates by virtue of rotation of the shaft 148 which is secured to an uncentered portion of bearing 109. Consequently, rotation of shaft 148 causes the bearing 109 to rotate and periodically lift the moving die 92. Moving die 92 is kept in its proper register by guides that keep the die in its proper position.

Other perforating means may also be used in the invention and may include mechanical devices such as a fixed die located above the segment 15 that has a plurality of moving pins to perforate, or non-mechanical devices such as a laser perforator which is activated when the segment is stopped.

Referring now to FIGS. 4–11, a complete perforation cycle showing the synchronization of the stopping and starting of a segment 15 of sheet material 12 with the reciprocating motion of the moving die 92. FIGS. 4–11 are schematic views which correspond generally to the view of apparatus 10 shown in FIG. 3. Reference points A, B, and C are shown to illustrate the comparative motion of the sheet material at various points in the apparatus. Arrow A indicates a section of sheet material in the apparatus prior to reaching the fixed roller 48 located upstream of the first orbital roller 20. Arrow B indicates a section of sheet material located intermediate the two orbital rollers 20 and 34. Arrow C indicates a section of sheet material in the apparatus moving after the fixed roller 54 which is located downstream of the second orbital roller 34. A series of registration marks are indicated on the sheet material 12 and 14 to schematically indicate the distance travelled by each section of the sheet material indicated by Arrows A, B, and C. The distance represented by the separation between each registration is equal in each case. As can be seen, each of Arrows A, B, and C travels from a first registration mark to a eighth registration mark during one complete cycle of the apparatus 10. The sections of sheet material indicated by Arrows A and C travel at an unvarying speed as they proceed from the first to the eighth registration mark. The section of sheet material indicated by Arrow B however is stopped during a portion of the cycle and is operated at double the speed of the sections of sheet material indicated by arrows A and C during another portion of the cycle.

As can be seen in FIGS. 4–11, each orbital roller 20 and 34 as viewed from this direction is travelling a counterclockwise path and is also itself rotating in a counterclockwise direction, while the fixed rollers 48 50, 52 and 54 are rotating in a clockwise direction. The different rotational directions of the orbital rollers and the fixed rollers are due to their relative locations and the path of the sheet material and the belt 58.

Figure 4:
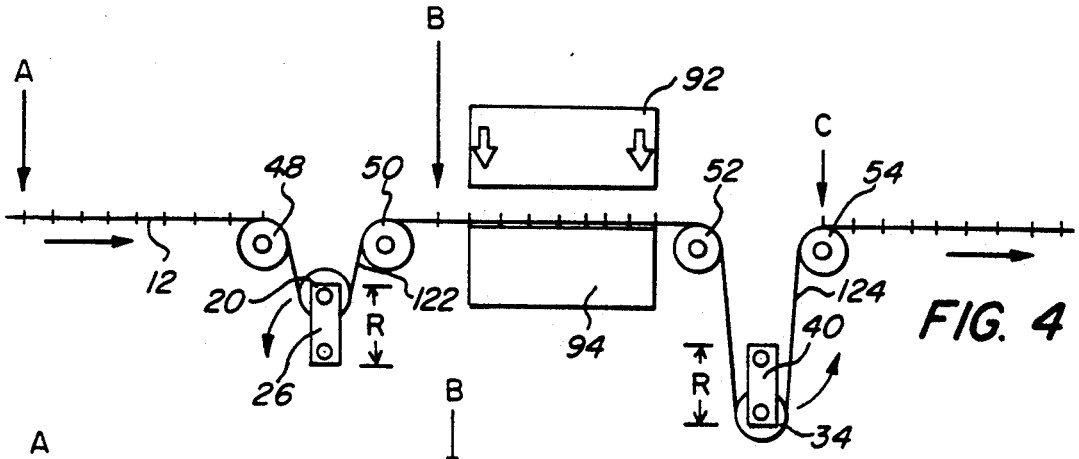
FIGS. 4–11 are schematic representations of the apparatus for perforation of a sheet material in accordance with the invention, showing the respective orbital paths of the first and second orbital rollers and the operation of the moving die during a complete cycle of the apparatus.

Referring now to FIG. 4, first orbital roller 20 is shown at 0 degrees and second orbital roller 34 is at 180 degrees. At this point, the first orbital roller 20 has just completed dispensing a stored loop of sheet material and is beginning to store another loop 122. The second orbital roller 34 has reached its maximum storage capacity of a stored loop 124 of sheet material 15 and is beginning to dispense the stored loop 124. This causes the segment 15 of sheet material 12 to be slowing down since the incoming sheet material is being stored on the first orbital roller 20 and an exiting web of sheet material is being provided by the second roller 34. Arrow A is at the first registration mark in its path, Arrow B is slowing down at the first registration mark in its path, which is within the perforation zone of the die, and Arrow C is at the first registration mark in its path. The cam lifter apparatus 146 is causing the moving die 92 to move downwardly toward the fixed mating bed 94.

Figure 5:
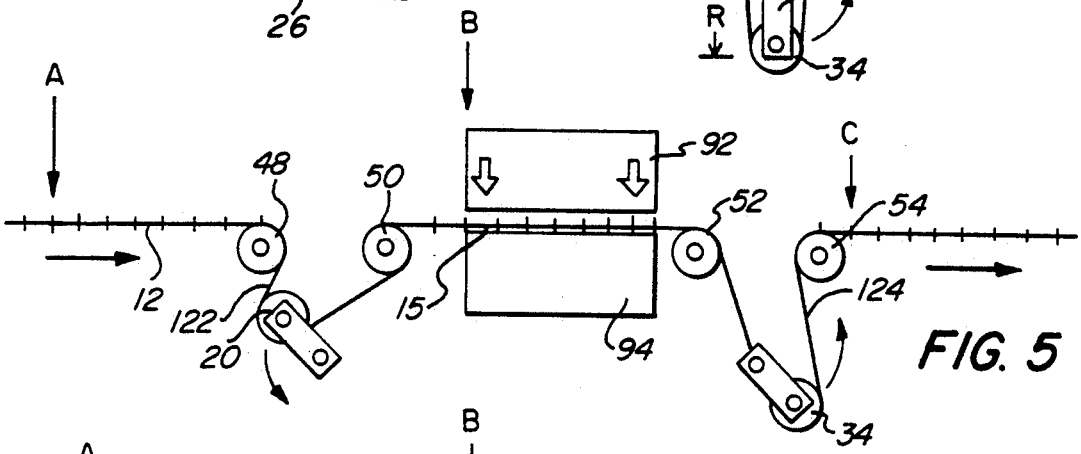

Referring now to FIG. 5, first orbital roller 20 is shown at 315 degrees and second orbital roller 34 is at 135 degrees. At this point, the first orbital roller 20 is increasing the size of the stored loop 122. The second orbital roller 34 is dispensing the stored loop 124. Segment 15 is slowing down in the perforation zone of the moving die 92. Arrow A has moved to the second registration mark in its path, Arrow B is slowing down at the second registration mark in its path, and Arrow C has moved to the second registration mark in its path. The cam lifter apparatus 146 is causing the moving die 92 to continue to move downwardly toward the fixed bed 94 to perforate the segment 15 of sheet material.

Figure 6:
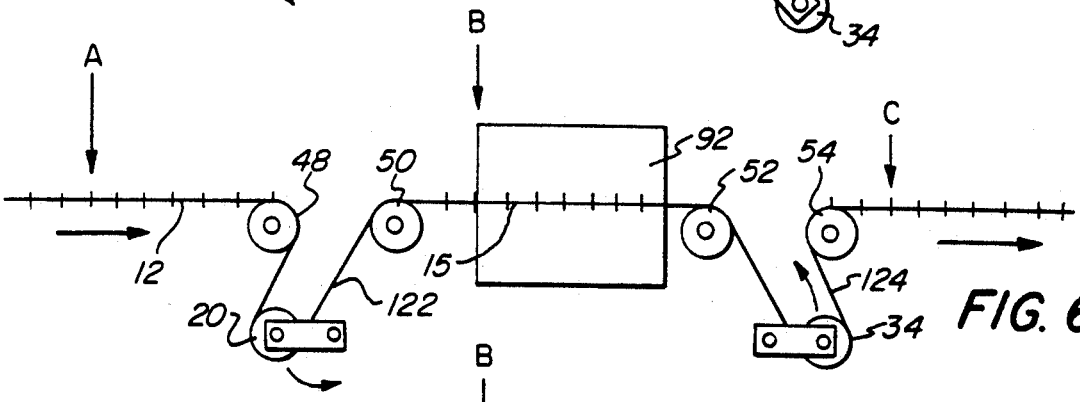

Referring now to FIG. 6, first orbital roller 20 is shown at 270 degrees and second orbital roller 34 is at 90 degrees. At this point, the two orbital rollers are a maximum distance apart. The segment 15 is now stopped since the incoming sheet material is still being stored at its maximum rate on the first orbital roller 20 and an exiting web of sheet material is still being dispensed at its maximum rate by the second roller 34. Arrow A has moved to the third registration mark in its path, Arrow B is now stopped at the second registration mark in its path, and Arrow C has moved to the third registration mark in its path. The cam lifter apparatus 146 is at the end of its downward stroke so that the moving die 92 has reached the end of its stroke and is perforating the segment 15 of sheet material.

Figure 7:
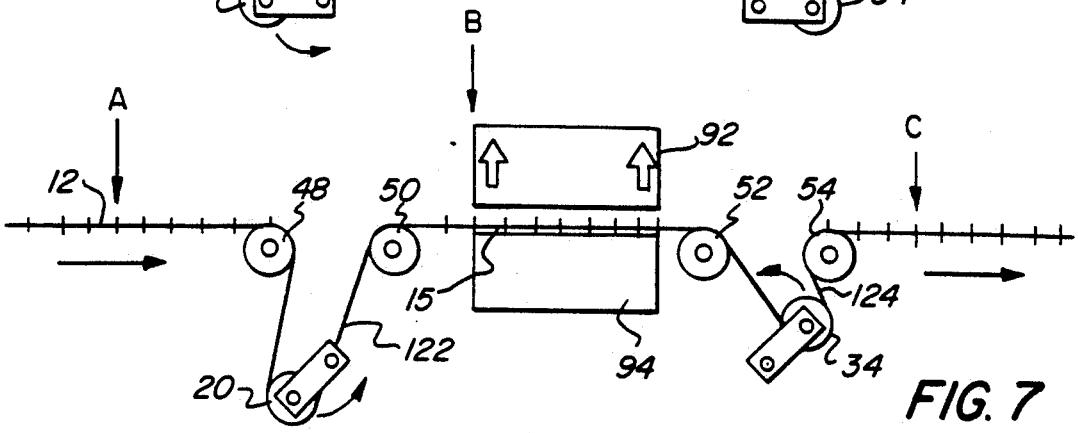

Referring now to FIG. 7, first orbital roller 20 is shown at 225 degrees and second orbital roller 34 is at 45 degrees. The segment 15 is beginning to move since the incoming sheet material is being stored at a slower rate on the first orbital roller 20 and an exiting web of sheet material is also being dispensed at a slower rate by the second roller 34. The first orbital roller 20 is still increasing the size of the stored loop 122. The second orbital roller 34 is still dispensing the stored loop 124. Arrow A has moved to the fourth registration mark in its path, Arrow B is beginning to move from the second registration mark in its path, and Arrow C has moved to the fourth registration mark in its path. The cam lifter apparatus 146 has begun its upward stroke and is lifting the moving die 92 upwardly to withdraw the perforating pins from the segment 15 of sheet material.

Figure 8:
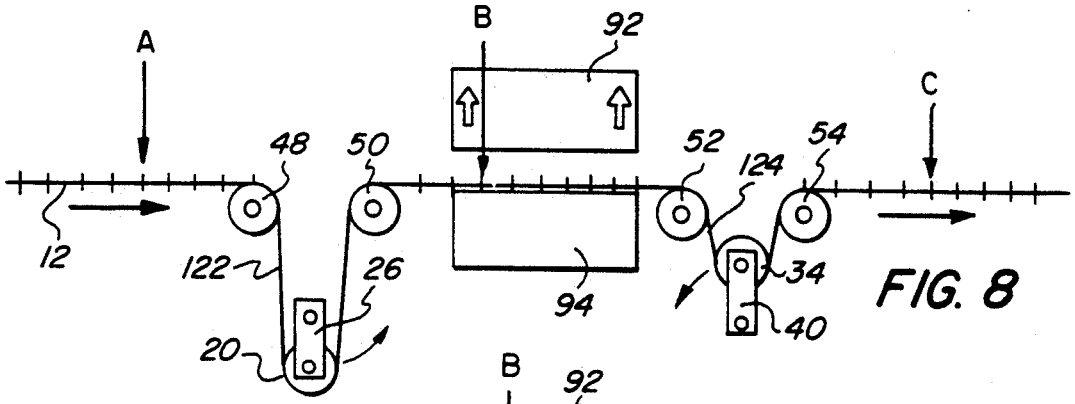

Referring now to FIG. 8, first orbital roller 20 is shown at 180 degrees and second orbital roller 34 is at 0 degrees. At this point, the first orbital roller 20 has just completed its take-up and storage stage and will begin dispensing the stored loop 122 of sheet material. The second orbital roller 34 has completed its dispensing stage and will begin take-up and storage of a new stored loop 124 of sheet material which is going to be dispensed from the perforating zone at an increasing rate. Arrow A is at the fifth registration mark in its path, Arrow B is moving at the third registration mark in its path and will continue increasing its speed as the segment 15 is conveyed from the perforation zone and a new segment is located in its place, and Arrow C is at the fifth registration mark in its path. The cam lifter apparatus 146 is in its upward stroke and has retracted the perforating pins and moving die 92 away from the sheet material.

Figure 9:
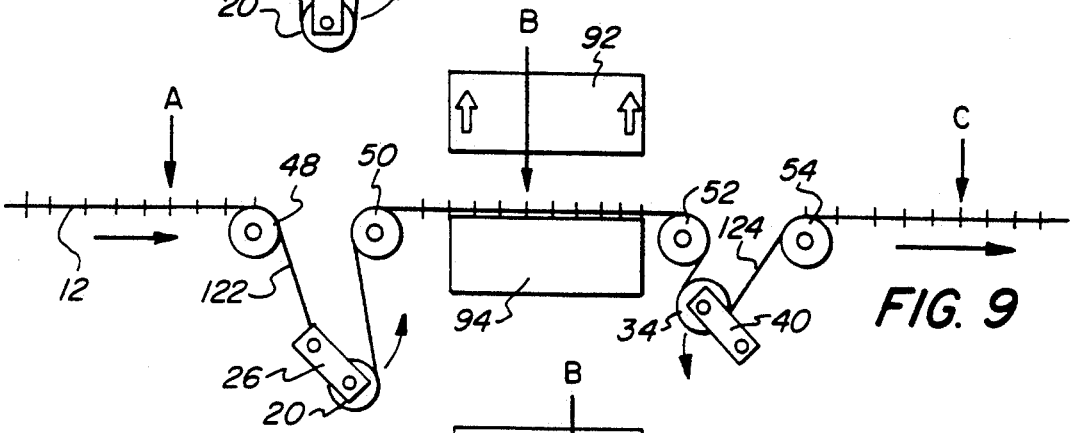

Referring now to FIG. 9, first orbital roller 20 is shown at 135 degrees and second orbital roller 34 is at 315 degrees. At this point, the first orbital roller is dispensing the stored loop 122 of sheet material. It is to be appreciated that at this point the sheet material throughput through the perforating zone is approaching twice the entry speed of the sheet material into the apparatus. This is due to the addition of the stored loop 122 being dispensed to the baseline throughput speed. The exit speed is however unaffected because the second orbital roller 34 is acting to take-up and store in loop 124 the additional sheet material traversing the perforating zone. Arrow A is at the sixth registration mark in its path, Arrow B is now approaching double speed and is at the fifth registration mark in its path, and Arrow C is at the sixth registration mark in its path. The cam lifter apparatus 146 is still in its upward stroke lifting the moving die 92.

Referring now to FIG. 10, first orbital roller 20 is shown at 90 degrees and second orbital roller 34 is at 270 degrees. At this point the orbital rollers 20 and 34 are their minimum distance apart and the cam lifter 146 has reached the limit of its travel withdrawing the moving die 92 from the mating bed 94. The sheet material in the perforating zone is now moving at twice the apparatus entry and exit speeds. The first orbital roller 20 continues to dispense the loop 122 and the second orbital roller 34 is taking up and storing the loop 124. Arrow A is at the seventh registration mark in its path, Arrow B is at the seventh registration mark in its path, and Arrow C is at the seventh registration mark in its path.

Referring now to FIG. 11, first orbital roller 20 is shown at 45 degrees and second orbital roller 34 is at 225 degrees. The sheet material in the perforating zone starts reducing its speed relative to the entry and exit speeds of the sheet material into and from the apparatus. The first orbital roller 20 is dispensing the loop 122 and the second orbital roller 34 is taking up and storing the loop 124. Arrow A is at the eighth registration mark in its path, Arrow B is at the eighth registration mark in its path, and Arrow C is at the eighth registration mark in its path. The cam lifter apparatus 146 is beginning its downward stroke to bring the moving die 92 to the mating bed 94.

FIGS. 4–11 display all the stages of a cycle of the stopping apparatus synchronized to the die. It is to be appreciated that the cycle repeats and that FIG. 4 shows the next stage of the cycle after FIG. 11. To complete the description of the advancement of Arrows A, B, and C, it should be noted that in the stage after FIG. 11, that the cycle will be repeated and that all sections indicated by the Arrows A, B, and C will have travelled an equal distance at the completion of the cycle.

A method of perforating a sheet material, in accordance with the invention generally follows the operation of the apparatus 10 discussed above, and generally involves feeding a web of the sheet material 12 into an entry 16 at a constant speed; dispensing the web of the sheet material 12 from an exit 18 at a constant speed; stopping a segment 15 of the web of the sheet material 12 intermediate the entry 16 and the exit 18 by providing for uptake of incoming sheet material on a first roller 20 travelling in an orbital path and by providing for dispensing of exiting sheet material from a second roller 34 travelling in an orbital path. The first and second rollers 20 and 34 move in their respective orbital paths in the same orbital direction at the same radius and speed and in positions which are 180 degrees apart. The method further includes moving a moving die having a plurality of means for perforating the web toward the segment 15 of the web and perforating the segment 15, and then disengaging the perforating die from the segment 15; and advancing the web of the sheet material to a next segment.

The present invention therefore provides a new and useful apparatus and method for perforating a web of a sheet material, particularly a sheet of postage stamps, with exceptionally precise perforations.

It is to be appreciated that the foregoing is illustrative and not limiting of the invention, and that various changes and modifications to the preferred embodiments described above will be apparent to those skilled in the art. Such changes and modifications can be made without departing from the spirit and scope of the present invention, and it is therefore intended that such changes and modifications be covered by the following claims.

What is claimed is:

1. Apparatus for perforating a continuous roll of a sheet material, comprising:

a feed mechanism for continuously moving the sheet material from an entry of said apparatus to an exit of said apparatus, said sheet material being moved at a constant and equal speed at said entry and said exit of said apparatus;

a die mechanism having a moving die and a mating bed, said moving die being provided with a plurality of means for perforating, said moving die being movable by reciprocating motion toward said mating bed sufficiently such that said means for perforating act on and perforate the sheet material, said moving die being further movable away from said mating bed such that said moving die and said means for perforating are disengaged from the sheet material;

a first orbital roller for receiving the sheet material having two ends, said first orbital roller having an offset mounting at each end, said offset mountings permitting said first orbital roller to be movable in an orbital path about an axis of said first orbital roller offset mountings;

a second orbital roller for receiving the sheet material having two ends, said second orbital roller having an offset mounting at each end, said offset mountings permitting said second orbital roller to be movable in an orbital path about an axis of said second orbital roller offset mountings;

said offset mountings being adjustable to vary a radius extending from said axes of said offset mountings and center axes of said orbital rollers;

said first orbital roller and said second orbital roller being driven in their respective orbital paths in the same orbital direction at the same radius and speed and in positions which are 180 degrees apart, whereby when said first and second orbital rollers are located a maximum distance apart, a segment of said sheet material intermediate said first and second orbital rollers is stopped; and a common drive mechanism for said first and said second orbital rollers and said reciprocating moving die, said common drive mechanism synchronizing the reciprocating motion of the moving die to the stoppage of the sheet material to permit said moving die to perforate said segment of the sheet material intermediate said first and second orbital rollers when the sheet material is stopped.

2. An apparatus for perforating a sheet material in accordance with claim 1, wherein said stopped sheet segment is perforated by said perforating means when said first and second orbital rollers are located a maximum distance apart, and said moving die and said means for perforating are withdrawn from said stopped sheet segment when said first and second rollers are a minimum distance apart.

3. An apparatus for perforating a sheet material in accordance with claim 2, wherein said reciprocating moving die further comprises a cam lift apparatus for lifting said die, said cam lift apparatus having a driveshaft, said driveshaft having at one end thereof a toothed pulley, and said offset mountings at one end of each of said first and second orbital rollers also being provided with toothed pulleys, said driveshaft and said offset mounting toothed pulleys being linked by an endless toothed belt.

4. An apparatus for perforating a sheet material in accordance with claim 3, wherein said feed mechanism comprises:

a first pair of fixed rollers flanking and above said first orbital roller;

a second pair of fixed rollers flanking and above said second orbital roller;

toothed pulleys provided in another end of each of said first and second orbital rollers, toothed pulleys provided in a same end of each of said first and second pairs of fixed rollers such that said fixed roller and orbital roller toothed pulleys are linked by an endless toothed conveyor belt;

a motor;

a transmission having an input and an output, said transmission input being operably connected to said motor by an endless toothed belt and pulleys and said transmission output being operably connected to said endless toothed conveyor belt.

5. An apparatus for perforating a sheet material in accordance with claim 4, wherein said driveshaft of said cam lifter is operably connected to said motor by a toothed belt engaging toothed pulleys on said motor and driveshaft.

6. An apparatus for perforating a sheet material in accordance with claim 4, wherein said means for perforating comprise a plurality of pins in said moving die and a plurality of mating pin receiving apertures in said mating bed.

7. An apparatus for perforating a sheet material in accordance with claim 6, wherein a plate is affixed to said moving die by resilient springs such that said plate is located between said plurality of pins and said mating bed when said moving die is in a retracted position from said mating bed, said plate having a plurality of apertures for extension of said plurality of pins therethrough, and being placeable against said mating bed and upon movement of said moving die towards said mating bed, said plurality of pins being extendable through said apertures in said plate and into said mating pin receiving apertures of said mating bed.

8. Apparatus for perforating a continuous roll of a sheet material, comprising:

a feeding mechanism for continuously moving the sheet material from an entry of said apparatus to an exit of said apparatus;

means for perforating the sheet material intermediate said entry and exit of said apparatus;

an intermittent feed apparatus intermediate said entry and said exit of said apparatus for receiving said sheet material and periodically stopping movement of a segment of the sheet material in a region of said perforating means, said intermittent feed apparatus including a first orbital roller having two ends, said first orbital roller having an offset mounting at each end, said offset mountings permitting said first orbital roller to be movable in an orbital path about an axis of said first orbital roller offset mountings, a second orbital roller having two ends, said second orbital roller having an offset mounting at each end, said offset mountings permitting said second orbital roller to be movable in an orbital path about an axis of said second orbital roller offset mountings, said first orbital roller and said second orbital roller being driven in their respective orbital paths in the same orbital direction at the same speed and in positions which are 180 degrees apart, and said sheet material segment being stopped intermediate said first and second orbital rollers when said first and second orbital rollers are located a maximum distance apart;

means for synchronizing activation of said perforation means to the stoppage of the sheet material to perforate the segment of the sheet material when the segment of sheet material is stopped.

9. An apparatus for perforating a sheet material in accordance with claim 8, wherein the stopped sheet segment is perforated by said perforating means when said first and second orbital rollers are located a maximum distance apart.

10. An apparatus for perforating a sheet material in accordance with claim 9, wherein said means for perforating comprise: a die having a moving die and a mating bed, said moving die being provided with a plurality of perforating pins, said moving die being movable by reciprocating motion toward said mating bed sufficiently such that said perforating pins act on and perforate the sheet material, said moving die being further movable away from said mating bed such that said moving die and said perforating pins can be disengaged from the sheet material.

11. An apparatus for perforating a sheet material in accordance with claim 10, wherein said synchronizing means comprises a common drive mechanism for said first and said second orbital rollers and said reciprocating moving die.

12. An apparatus for perforating a sheet material in accordance with claim 11, wherein said reciprocating moving die further comprises a cam lift apparatus for lifting said die, said cam lift apparatus having a driveshaft, said driveshaft having at one end thereof a toothed pulley, and said offset mountings at one end of each of said firs and second orbital rollers also being provided with toothed pulleys, said driveshaft and said offset mounting toothed pulleys being linked by an endless toothed belt.

13. An apparatus for perforating a sheet material in accordance with claim 10, wherein said feeding mechanism conveys said sheet material at a constant and equal speed at said entry and said exit of said apparatus.

14. An apparatus for perforating a sheet material in accordance with claim 13, wherein said feeding mechanism comprises:

a first pair of fixed rollers flanking said first orbital roller;

a second pair of fixed rollers flanking said second orbital roller;

means for commonly driving said first and second pair of rollers and said first and second orbital rollers to rotate at the same rotational speed.

15. An apparatus for perforating a sheet material in accordance with claim 14, wherein said common drive means comprises:

a toothed pulley provided in another end of each of said first and second orbital rollers, a toothed pulley provided in a same end of each of said first and second pairs of fixed rollers;

said fixed roller and orbital roller toothed pulleys being liked by a conveyor endless toothed belt.

16. An apparatus for perforating a sheet material in accordance with claim 15, wherein said means for commonly driving further comprises:

a motor;

a transmission having an input and an output, said input being operably connected to said motor by an endless toothed belt and pulleys;

said conveyor endless toothed belt being operably connected to said transmission output.

17. An apparatus for perforating a sheet material in accordance with claim 16, wherein said driveshaft of said cam lifter is operably connected to said motor by a toothed belt engaging toothed pulleys on said motor and driveshaft.

18. An apparatus for perforating a sheet material in accordance with claim 8, wherein said offset mountings are adjustable to vary a radius extending from said axes of said offset mountings and center axes of said orbital rollers.

19. An apparatus for perforating a sheet material in accordance with claim 10, wherein said mating bed is provided with a plurality of pin receiving apertures to receive the plurality of perforating pins provided in said moving die.

20. An apparatus for perforating a sheet material in accordance with claim 19, wherein an apertured plate is secured to said moving die by a spring mounting means whereby said plate is located between said plurality of pins and said mating bed when said moving die is retracted from said mating bed, said plate being placeable against said mating bed and upon movement of said moving die towards said mating bed, said plurality of pins being extendable through apertures in said plate and into said mating pin receiving apertures of said mating bed.

21. Apparatus for perforating a continuous roll of a sheet material, comprising:

a feeding mechanism for continuously moving the sheet material from an entry of said apparatus to an exit of said apparatus;

a first orbital roller having two ends, said first orbital roller having an offset mounting at each end, said offset mountings permitting said first orbital roller to be movable in an orbital path about an axis of said first orbital roller offset mountings;

a second orbital roller having two ends, said second orbital roller having an offset mounting at each end, said offset mountings permitting said second orbital roller to be movable in an orbital path about an axis of said second orbital roller offset mountings;

said first orbital roller and said second orbital roller being driven in their respective orbital paths in the same orbital direction at the same speed and in positions which are 180 degrees apart;

said sheet material segment being stopped intermediate said first and second orbital rollers when said first and second orbital rollers are located a maximum distance apart;

a die mechanism located intermediate said first and second orbital rollers, said die mechanism having a moving die and a mating bed, said moving die being provided with a plurality of means for perforating, said moving die being movable by reciprocating motion toward said mating bed sufficiently such that said means for perforating act on and perforate the sheet material, said moving die being further movable away from said mating bed such that said moving die and said means for perforating are disengaged from the sheet material; and means for synchronizing the reciprocating motion of the moving die to the stoppage of the sheet material to perforate said segment of the sheet material when the sheet material is stopped.

22. An apparatus for perforating a sheet material in accordance with claim 21, wherein said synchronizing means comprises a common drive mechanism for said first and said second orbital rollers and said reciprocating moving die wherein said reciprocating moving die further comprises a cam lift apparatus for lifting said die, said cam lift apparatus having a driveshaft, said driveshaft having at one end thereof a toothed pulley, and said offset mountings at one end of each of said first and second orbital rollers also being provided with toothed pulleys, said driveshaft and said offset mounting toothed pulleys being linked by an endless toothed belt.

23. An apparatus for perforating a sheet material in accordance with claim 22, wherein said feeding mechanism comprises:

a first pair of fixed rollers flanking said first orbital roller;

a second pair of fixed rollers flanking said second orbital roller;

a toothed pulley provided in another end of each of said first and second orbital rollers;

a toothed pulley provided in a same end of each of said first and second pairs of fixed rollers;

said fixed roller and orbital roller toothed pulleys being linked by a conveyor endless toothed belt driven by a means for motor driving, whereby said first and second pair of rollers and said first and second orbital rollers are commonly driven to rotate at the same rotational speed.

24. An apparatus for perforating a sheet material in accordance with claim 23, wherein said offset mountings are adjustable to vary a radius extending from said axes of said offset mountings and center axes of said orbital rollers.

* * * * *